US008419567B2

(12) United States Patent
Jertson et al.

(10) Patent No.: US 8,419,567 B2
(45) Date of Patent: Apr. 16, 2013

(54) GOLF COUPLING MECHANISMS AND RELATED METHODS

(75) Inventors: Marty R. Jertson, Phoenix, AZ (US); Ryan M. Stokke, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/468,677

(22) Filed: May 10, 2012

(65) Prior Publication Data

US 2013/0053165 A1 Feb. 28, 2013

Related U.S. Application Data

(63) Continuation of application No. 13/429,319, filed on Mar. 24, 2012.

(60) Provisional application No. 61/529,880, filed on Aug. 31, 2011, provisional application No. 61/590,232, filed on Jan. 24, 2012.

(51) Int. Cl.
*A63B 53/02* (2006.01)

(52) U.S. Cl.
USPC ..... 473/307; 473/246; 473/309; 473/345; 473/288

(58) Field of Classification Search ..... 473/244–248, 473/288, 307, 309, 345–346
See application file for complete search history.

(56) References Cited

U.S. PATENT DOCUMENTS

| | | | |
|---|---|---|---|
| 1,540,559 | A | 6/1925 | Murphy |
| 1,610,802 | A | 12/1926 | McNair |
| 1,623,523 | A | 4/1927 | Bourke |
| 1,918,583 | A | 7/1933 | Bear |
| 2,027,452 | A | 1/1936 | Rusing |
| 2,051,961 | A | 8/1936 | Mears |
| 2,175,598 | A | 10/1939 | Fedak |
| 2,219,670 | A | 10/1940 | Wettlaufer |
| 2,425,808 | A | 8/1947 | John |
| 2,644,689 | A | 7/1953 | Putnam |
| 3,170,691 | A | 2/1965 | Pritchard |
| 3,524,646 | A | 8/1970 | Wheeler |
| 3,601,399 | A | 8/1971 | Agens et al. |
| 3,685,135 | A | 8/1972 | Letters |
| 3,840,231 | A | 10/1974 | Moore |
| 4,664,382 | A | 5/1987 | Palmer et al. |
| 4,815,740 | A | 3/1989 | Williams et al. |
| 4,852,782 | A | 8/1989 | Wu et al. |
| 4,854,582 | A | 8/1989 | Yamada |
| 4,943,059 | A | 7/1990 | Morell |
| 4,948,132 | A | 8/1990 | Wharton |
| 5,039,098 | A | 8/1991 | Pelz |
| 5,433,442 | A | 7/1995 | Walker |
| 5,441,274 | A | 8/1995 | Clay |
| 5,538,245 | A | 7/1996 | Moore |
| 5,722,901 | A | 3/1998 | Barron et al. |

(Continued)

FOREIGN PATENT DOCUMENTS

| | | | |
|---|---|---|---|
| EP | 0535848 | A1 | 4/1993 |
| GB | 2241173 | A1 | 8/1991 |

(Continued)

*Primary Examiner* — Stephen L. Blau

(57) ABSTRACT

Embodiments of golf coupling mechanisms are presented herein. Other examples and related methods are also disclosed herein.

13 Claims, 9 Drawing Sheets

U.S. PATENT DOCUMENTS

| | | | | |
|---|---|---|---|---|
| 5,924,938 | A | 7/1999 | Hines | |
| 5,951,411 | A | 9/1999 | Wood et al. | |
| 6,050,903 | A | 4/2000 | Lake | |
| 6,547,673 | B2 | 4/2003 | Roark | |
| 6,857,969 | B2 | 2/2005 | Rice | |
| 6,863,622 | B1 | 3/2005 | Hsu | |
| 7,083,529 | B2 | 8/2006 | Cackett et al. | |
| 7,300,359 | B2 | 11/2007 | Hocknell et al. | |
| 7,344,449 | B2 | 3/2008 | Hocknell et al. | |
| 7,438,645 | B2 | 10/2008 | Hsu | |
| 7,465,239 | B2 | 12/2008 | Hocknell et al. | |
| 7,530,900 | B2 | 5/2009 | Holt et al. | |
| 7,578,749 | B2 | 8/2009 | Hocknell et al. | |
| 7,699,717 | B2 | 4/2010 | Morris et al. | |
| 7,722,475 | B2 | 5/2010 | Thomas et al. | |
| 7,874,934 | B2 | 1/2011 | Soracco et al. | |
| 7,878,921 | B2 | 2/2011 | Bennett et al. | |
| 7,955,182 | B2 | 6/2011 | Thomas et al. | |
| 7,963,855 | B2 | 6/2011 | Sander et al. | |
| 7,980,959 | B2 | 7/2011 | Morris et al. | |
| 7,997,997 | B2 | 8/2011 | Bennett et al. | |
| 8,057,320 | B2 | 11/2011 | Bennett et al. | |
| 8,133,131 | B1 | 3/2012 | Bennett et al. | |
| 8,142,306 | B2 | 3/2012 | De La Cruz et al. | |
| 8,147,351 | B2 | 4/2012 | Bennett et al. | |
| 8,207,507 | B2 | 6/2012 | Zaitseva et al. | |
| 8,216,084 | B2 | 7/2012 | Bennett et al. | |
| 2001/0007835 | A1 | 7/2001 | Baron | |
| 2005/0101402 | A1 | 5/2005 | Kawakami | |
| 2005/0239576 | A1* | 10/2005 | Stites et al. | 473/345 |
| 2006/0281575 | A1 | 12/2006 | Hocknell et al. | |
| 2006/0287125 | A1 | 12/2006 | Hocknell et al. | |
| 2006/0293115 | A1 | 12/2006 | Hocknell et al. | |
| 2006/0293116 | A1 | 12/2006 | Hocknell et al. | |
| 2007/0117645 | A1 | 5/2007 | Nakashima | |
| 2008/0254909 | A1 | 10/2008 | Callinan et al. | |
| 2008/0261716 | A1 | 10/2008 | Sugimoto | |
| 2008/0293510 | A1 | 11/2008 | Yamamoto | |
| 2009/0062029 | A1 | 3/2009 | Stites et al. | |
| 2009/0075749 | A1 | 3/2009 | De La Cruz et al. | |
| 2009/0124407 | A1 | 5/2009 | Hocknell et al. | |
| 2009/0247316 | A1 | 10/2009 | De La Cruz et al. | |
| 2009/0264214 | A1 | 10/2009 | De La Cruz et al. | |
| 2009/0275423 | A1 | 11/2009 | Yamamoto | |
| 2009/0286611 | A1 | 11/2009 | Beach et al. | |
| 2009/0286618 | A1 | 11/2009 | Beach et al. | |
| 2009/0286619 | A1 | 11/2009 | Beach et al. | |
| 2010/0016094 | A1 | 1/2010 | Hocknell et al. | |
| 2010/0035700 | A1 | 2/2010 | Yu et al. | |
| 2010/0035701 | A1 | 2/2010 | Kusumoto | |
| 2010/0041491 | A1 | 2/2010 | Thomas et al. | |
| 2010/0120550 | A1 | 5/2010 | Galloway | |
| 2010/0120552 | A1 | 5/2010 | Sander et al. | |
| 2010/0144459 | A1 | 6/2010 | Sato et al. | |
| 2010/0197423 | A1 | 8/2010 | Thomas et al. | |
| 2010/0197424 | A1 | 8/2010 | Beach et al. | |
| 2010/0203981 | A1 | 8/2010 | Morris et al. | |
| 2010/0261543 | A1 | 10/2010 | Breier et al. | |
| 2010/0323808 | A1 | 12/2010 | Sato et al. | |
| 2010/0323809 | A1 | 12/2010 | Murphy | |
| 2010/0331121 | A1 | 12/2010 | Morris et al. | |
| 2011/0009206 | A1 | 1/2011 | Soracco | |
| 2011/0021282 | A1 | 1/2011 | Sander | |
| 2011/0105242 | A1 | 5/2011 | Beach et al. | |
| 2011/0118044 | A1 | 5/2011 | Sato et al. | |
| 2011/0118045 | A1 | 5/2011 | Sato et al. | |
| 2011/0118048 | A1 | 5/2011 | Soracco et al. | |
| 2011/0118051 | A1* | 5/2011 | Thomas | 473/328 |
| 2011/0143854 | A1 | 6/2011 | Bennett et al. | |
| 2011/0152000 | A1* | 6/2011 | Sargent et al. | 473/334 |
| 2011/0177876 | A1 | 7/2011 | Bennett et al. | |
| 2011/0190072 | A1 | 8/2011 | Beach et al. | |
| 2011/0201447 | A1 | 8/2011 | Thomas et al. | |
| 2011/0207547 | A1 | 8/2011 | Sander et al. | |
| 2011/0275448 | A1 | 11/2011 | Morris et al. | |
| 2011/0287853 | A1 | 11/2011 | Sato | |
| 2011/0312437 | A1* | 12/2011 | Sargent et al. | 473/335 |
| 2011/0319185 | A1 | 12/2011 | Beach et al. | |
| 2012/0010015 | A1 | 1/2012 | Bennett et al. | |
| 2012/0034994 | A1 | 2/2012 | Knutson et al. | |
| 2012/0034995 | A1 | 2/2012 | Harvell et al. | |
| 2012/0034996 | A1 | 2/2012 | Murphy et al. | |
| 2012/0071261 | A1 | 3/2012 | Yamamoto | |
| 2012/0100926 | A1 | 4/2012 | Golden et al. | |
| 2012/0165112 | A1 | 6/2012 | Bennett et al. | |

FOREIGN PATENT DOCUMENTS

| | | | |
|---|---|---|---|
| GB | 2363340 | A | 12/2001 |
| GB | 2387550 | A | 10/2003 |
| JP | 2001017584 | A | 1/2001 |
| JP | 2003070940 | A | 3/2003 |
| JP | 2009/050676 | | 3/2009 |
| KR | 2007/0021382 | | 2/2007 |
| WO | 2009035345 | | 3/2009 |
| WO | 2010039658 | A2 | 4/2010 |
| WO | 2011048969 | A1 | 4/2011 |

* cited by examiner

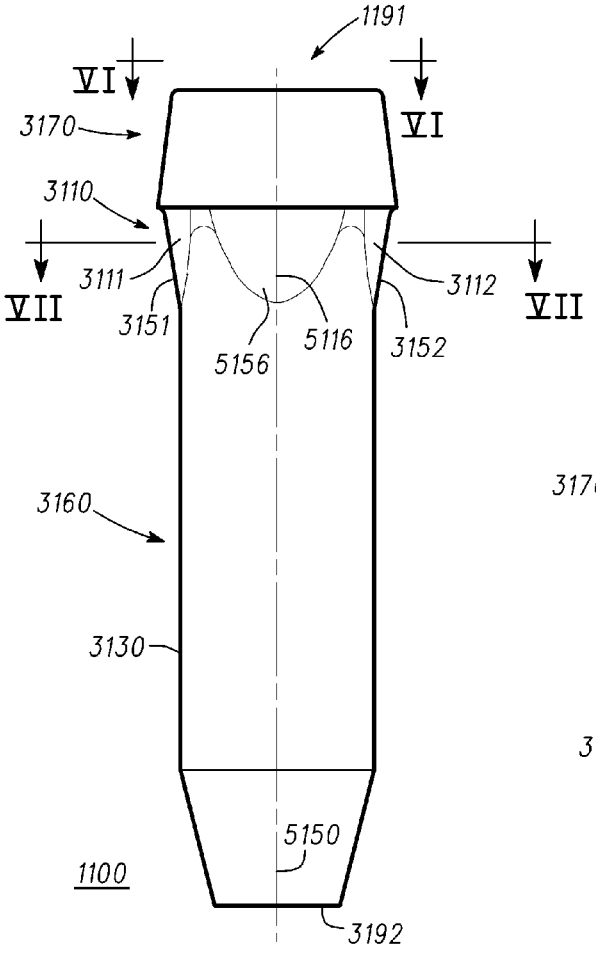
Fig. 5
Fig. 6
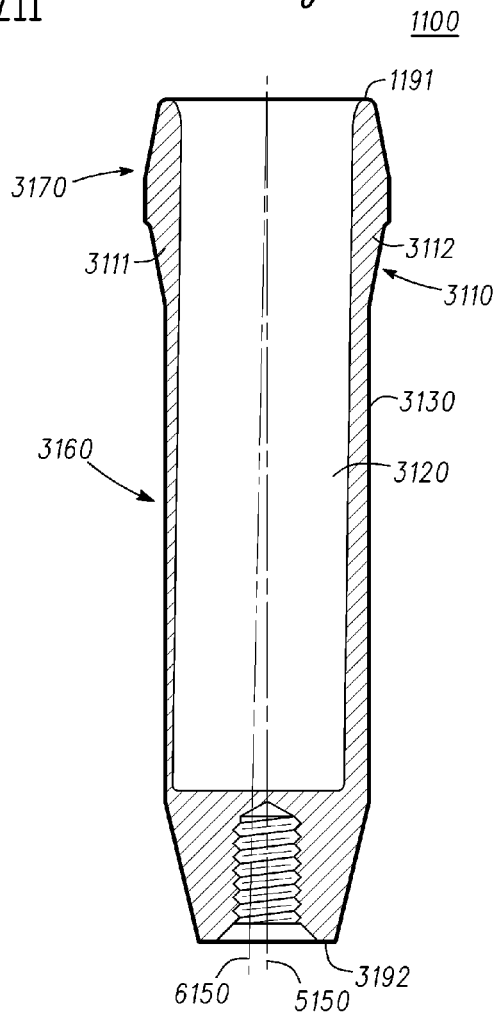

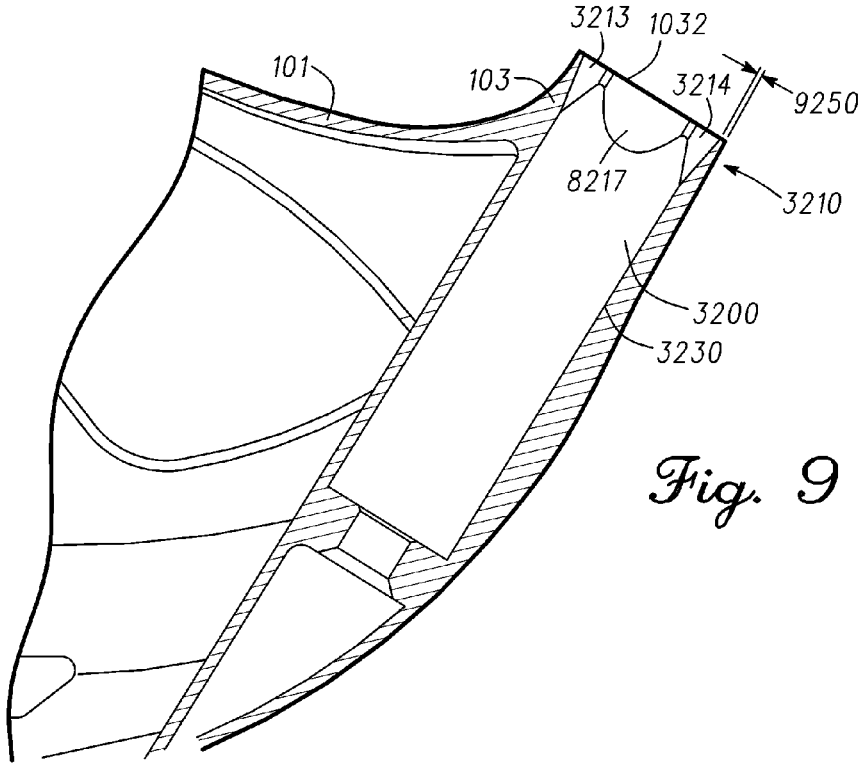
Fig. 9
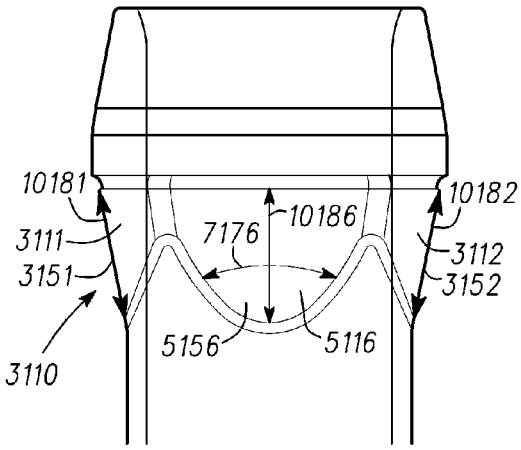
1100 Fig. 10
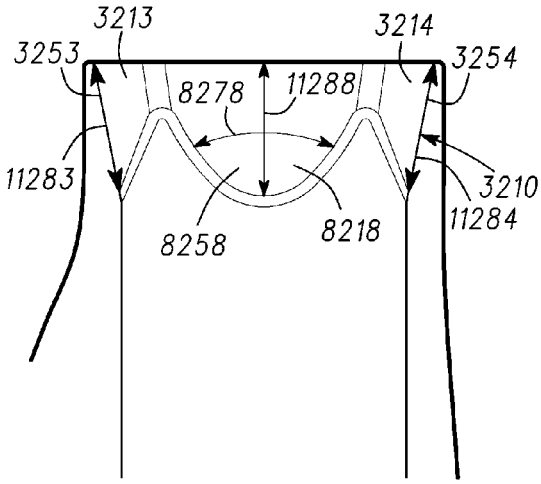
Fig. 11 3200

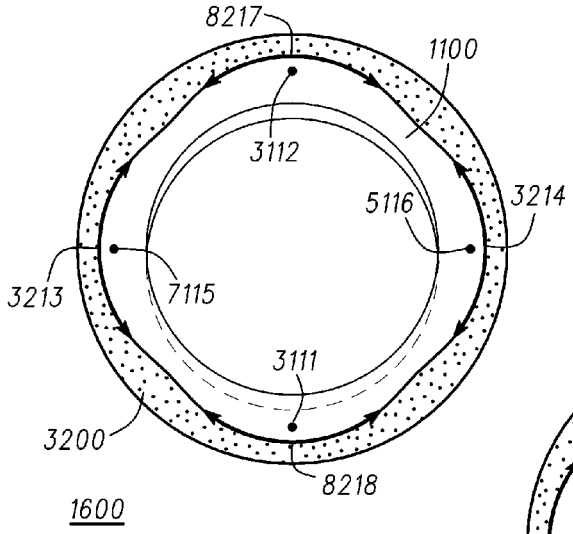
Fig. 16
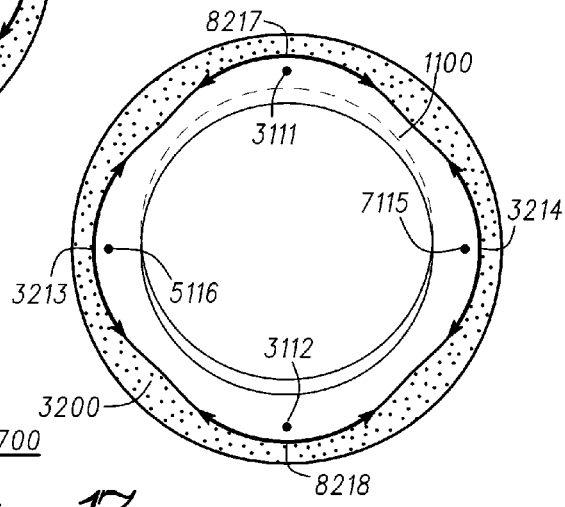
Fig. 17
Fig. 18
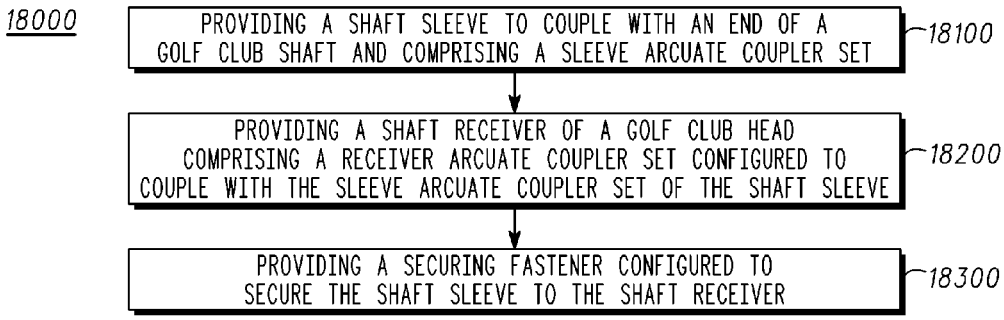

GOLF COUPLING MECHANISMS AND RELATED METHODS

CROSS-REFERENCE TO RELATED APPLICATION

This application is a continuation of U.S. patent application Ser. No. 13/429,319, filed on Mar. 24, 2012, and claims the benefit of U.S. Provisional Patent Application No. 61/529,880, filed on Aug. 31, 2011, and of U.S. Provisional Patent Application No. 61/590,232, filed on Jan. 24, 2012. The disclosures of the referenced applications are incorporated herein by reference.

TECHNICAL FIELD

The present disclosure relates generally to sports equipment, and relates, more particularly, to golf coupling mechanisms and related methods.

BACKGROUND

Several sports, like golf, require equipment with features that can be selected or custom-fit to an individual's characteristics or preferences. For example, the recommended type of club shaft, type of club head, and/or the loft or lie angle of the club head may vary based on the individual's characteristics, such as skill, age or height. Once assembled, however, golf clubs normally have fixed, unchangeable coupling mechanisms between their golf club shafts and golf club heads. Accordingly, when determining suitable equipment for the individual, an unnecessarily large number of golf clubs with such fixed coupling mechanisms must be available to test different combinations of club shafts, club heads, loft angles, and/or lie angles. In addition, if the individual's characteristics or preferences were to change, his golf equipment would not be adjustable to account for such changes. Adjustable coupling mechanisms can be configured to provide such flexibility in changeably setting different features of golf clubs, but may introduce instabilities leading to lack of cohesion or concentrations of stress at the golf club head and golf club shaft coupling. Considering the above, further developments in golf coupling mechanisms and related methods will enhance utilities and adjustability features for golf clubs.

BRIEF DESCRIPTION OF THE DRAWINGS

The present disclosure may be better understood from a reading of the following detailed description of examples of embodiments, taken in conjunction with the accompanying figures.

FIG. 5 illustrates a side view of the shaft sleeve decoupled from the golf club head.

FIG. 6 illustrates a cross sectional view of the shaft sleeve along cross-sectional line VI-VI of FIG. 5.

FIG. 9 illustrates a side cross-sectional side view of the golf club head of FIG. 1 along cross-sectional line of FIG. 2, with the shaft sleeve removed therefrom.

FIG. 10 illustrates a side view of a portion of a sleeve coupler set of the shaft sleeve.

FIG. 11 illustrates a side x-ray view of a portion a receiver coupler set of the shaft receiver.

FIG. 16 illustrates a top cross-sectional view of the golf coupling mechanism in a third configuration, with respect to the viewpoint of with the shaft sleeve removed therefrom line XIV-XIV of FIG. 4.

FIG. 17 illustrates a top cross-sectional view of the golf coupling mechanism in a fourth configuration, with respect to the viewpoint of with the shaft sleeve removed therefrom line XIV-XIV of FIG. 4.

FIG. 18 illustrates a flowchart for a method that can be used to provide, form, and/or manufacture a golf coupler mechanism in accordance with the present disclosure.

Figure 1:
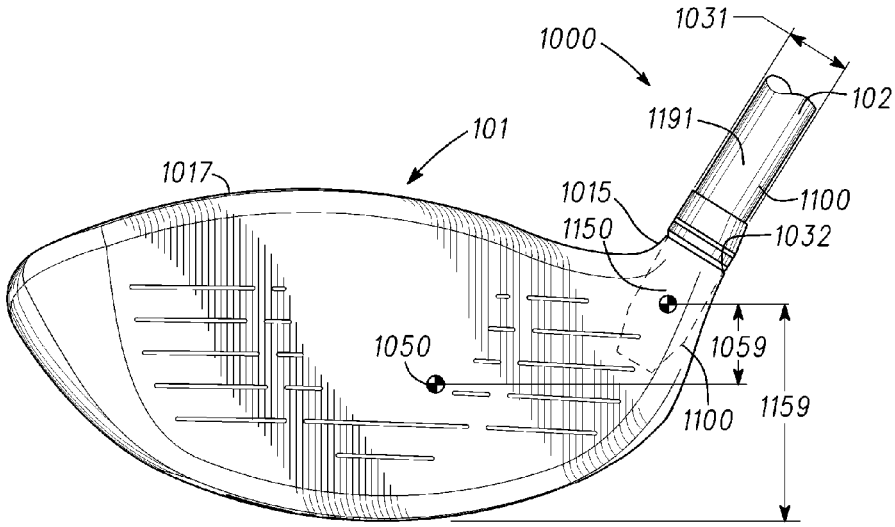
FIG. 1 illustrates a front perspective view of a golf club head with a golf coupling mechanism according to one example of the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DETAILED DESCRIPTION

In one example, a golf coupling mechanism for a golf club head and a golf club shaft can comprise a shaft sleeve configured to be coupled to an end of the golf club shaft. The shaft sleeve can comprise a shaft bore configured to receive the end of the golf club shaft, a sleeve axis extending along a longitudinal centerline of the shaft sleeve, from a sleeve top end to a sleeve bottom end of the shaft sleeve, a sleeve outer wall centered about the sleeve axis, a first coupler protruding from the sleeve outer wall, and a second coupler protruding from the sleeve outer wall. The first coupler can comprise a first arcuate surface curved throughout the first coupler. The second coupler can comprise a second arcuate surface curved throughout the second coupler. The first and second arcuate surfaces can be configured to restrict a rotation of the shaft sleeve relative to the golf club head.

In one example, a method for providing a golf coupling mechanism can comprise providing a shaft sleeve configured to be coupled to an end of a golf club shaft. Providing the shaft sleeve can comprise providing a sleeve axis extending along a longitudinal centerline of the shaft sleeve, from a sleeve top end to a sleeve bottom end of the shaft sleeve, providing a sleeve outer wall a sleeve outer wall centered about the sleeve axis, providing a first coupler protruding from the sleeve outer wall, and providing a second coupler protruding from the sleeve outer wall. Providing the first coupler can comprise providing a first arcuate surface curved throughout the first coupler. Providing the second coupler can comprise providing a second arcuate surface curved throughout the second coupler. Wherein the first and second arcuate surfaces can be configured to restrict a rotation of the shaft sleeve relative to a golf club head.

In one example, a golf club can comprise a golf club head, a golf club shaft, and a golf coupling mechanism for coupling the golf club head and the golf club shaft together. The golf coupling mechanism can comprises a shaft sleeve configured to be coupled to an end of the golf club shaft, and a shaft receiver of the golf club head configured to receive the shaft sleeve. The shaft sleeve can comprise a sleeve axis extending along a longitudinal centerline of the shaft sleeve, from a sleeve top end to a sleeve bottom end of the shaft sleeve, a shaft bore non-coaxial to the sleeve axis and configured to receive the end of the golf club shaft, a sleeve outer wall centered about the sleeve axis, a sleeve insertion portion bounded by the sleeve outer wall and configured to be inserted into the shaft receiver, a first coupler protruding from the sleeve outer wall, and a second coupler protruding from the sleeve outer wall. The shaft receiver can comprise a receiver inner wall configured to bound the sleeve outer wall when the sleeve insertion portion is in the shaft receiver, a third coupler indented into the receiver inner wall, and a fourth coupler indented into the receiver inner wall. The first coupler comprises a first arcuate surface curved throughout the first coupler. The first arcuate surface can comprise a first vertical radius of curvature of at least approximately 10.1 mm and a first horizontal radius of curvature of approximately 2.5 mm to approximately 5.7 mm. The second coupler can comprise a second arcuate surface curved throughout the second coupler. The second arcuate surface can comprise a second vertical radius of curvature of at least approximately 10.1 mm and a second horizontal radius of curvature of approximately 2.5 mm to approximately 5.7 mm. The third coupler can comprise a third arcuate surface complementary with at least a portion of the third arcuate surface of the first coupler. The third arcuate surface can comprise a third vertical radius of curvature of at least approximately 10.1 mm and a third horizontal radius of curvature of approximately 2.5 mm to approximately 5.7 mm. The fourth coupler can comprise a fourth arcuate surface complementary with at least a portion of the second arcuate surface of the second coupler. The fourth arcuate surface can comprise a fourth vertical radius of curvature of at least approximately 10.1 mm and a fourth horizontal radius of curvature of approximately 2.5 mm to approximately 5.7 mm. The first, second, third, and fourth arcuate surfaces can be configured to restrict a rotation of the shaft sleeve relative to the golf club head.

Other examples and embodiments are further disclosed herein. Such examples and embodiments may be found in the figures, in the claims, and/or in the present description.

Figure 2:
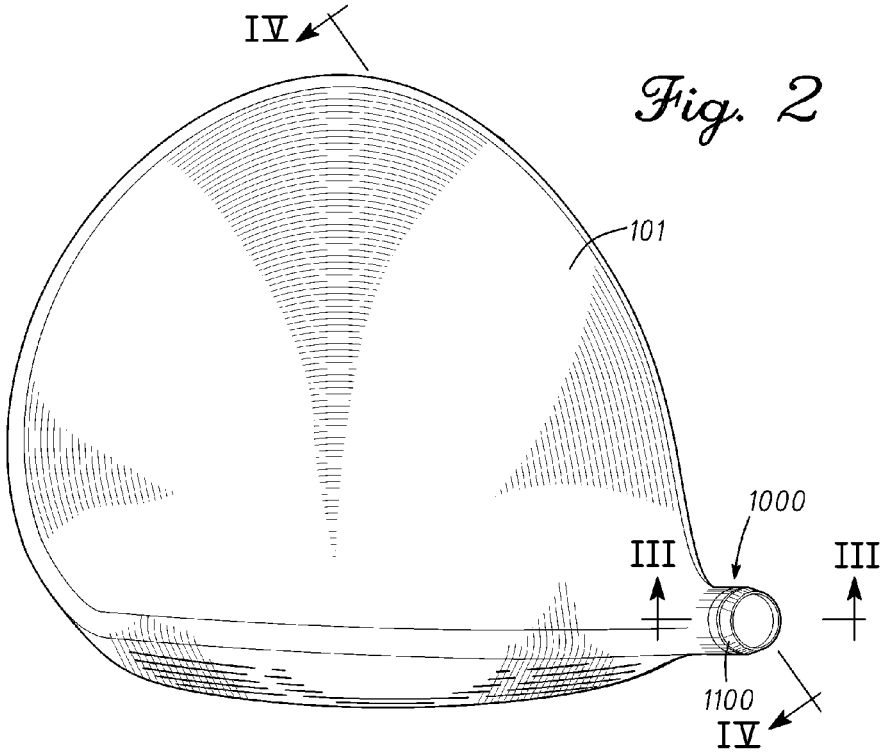
FIG. 2 illustrates a top perspective view of the golf club head with the golf coupling mechanism of FIG. 1.
Figure 3:
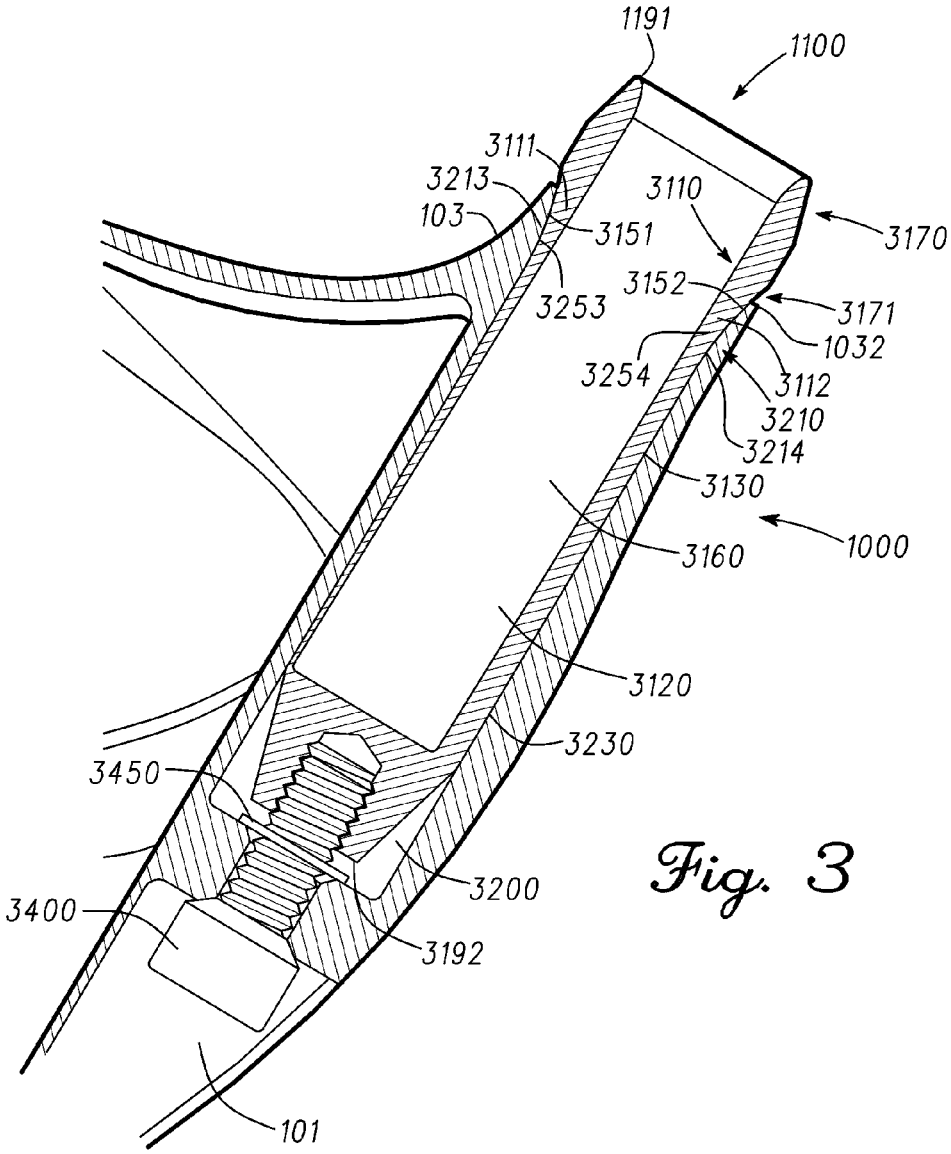
FIG. 3 illustrates a cross-sectional view of the golf club head along cross-sectional line III-III of FIG. 2, showing the golf coupling mechanism with a shaft sleeve inserted into a shaft receiver.

Turning to the drawings, FIG. 1 illustrates a front perspective view of golf club head 101 with golf coupling mechanism 1000 according to one example of the present disclosure. FIG. 2 illustrates a top perspective view of golf club head 101 with golf coupling mechanism 1000. FIG. 3 illustrates a cross-sectional view of golf club head 101 along line of FIG. 2, showing golf coupling mechanism 1000 with shaft sleeve

Figure 4:
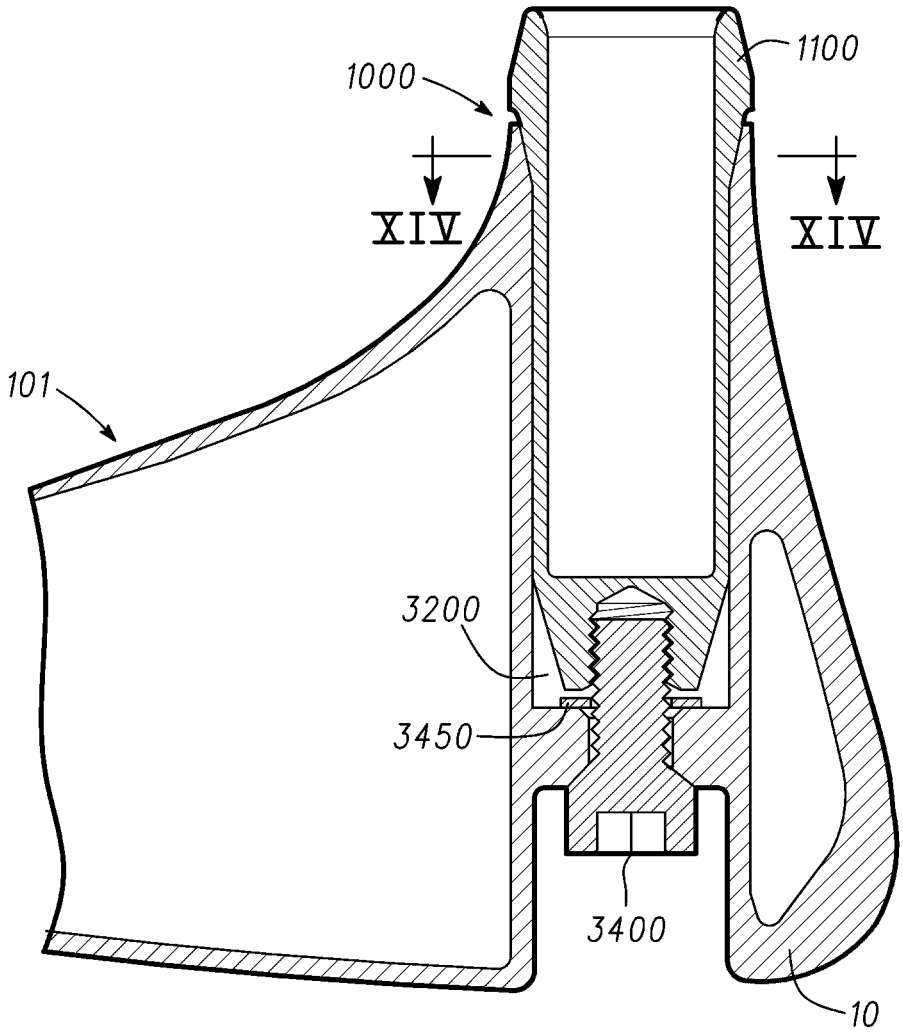
FIG. 4 illustrates a cross-sectional view of the golf club head and the golf coupling mechanism along cross-sectional line IV-IV of FIG. 2.

1100 inserted into shaft receiver 3200. FIG. 4 illustrates a cross-sectional view of golf club head 101 and golf coupling mechanism 1000 along line IV-IV of FIG. 2.

In the present embodiment, golf coupling mechanism 1000 comprises shaft sleeve 1100 configured be coupled to an end of a golf club shaft, such as golf club shaft 102 (FIG. 1). FIG. 5 illustrates a side view of shaft sleeve 1100 decoupled from golf club head 101 (FIG. 1). FIG. 6 illustrates a cross sectional view of shaft sleeve 1100 along line VI-VI of FIG. 5. In the present example, shaft sleeve 1100 comprises shaft bore 3120 configured to receive the end of golf club shaft 102. Shaft sleeve 1100 also comprises sleeve axis 5150 extending along a longitudinal centerline of shaft sleeve 1100, from sleeve top end 1191 to sleeve bottom end 3192. Sleeve outer wall 3130 is a right angle cylinder such that at least portions of sleeve outer wall 3130 are substantially parallel to sleeve axis 5150 in the present example, and bound shaft bore 3120 therewithin. In other words, sleeve axis 5150 is the center of sleeve outer wall 3130 in this embodiment. In the present example, shaft bore 3120 extends coaxially to shaft bore axis 6150, and is angled with respect to sleeve axis 5150, thus being non-coaxial thereto. Shaft bore axis 6150 is angled at approximately 0.5 degrees from sleeve axis 5150 in the present example, but there can be examples where such angle can be of approximately 0.2 degrees to approximately 4 degrees relative to sleeve axis 5150. Accordingly, shaft bore 3210 and sleeve outer wall 3130 are not concentric in this embodiment. There can be other embodiments, however, where shaft bore axis 6150 can be substantially collinear with sleeve axis 5150, such that sleeve outer wall 3130 and shaft bore 3120 can be substantially concentric.

Figure 7:
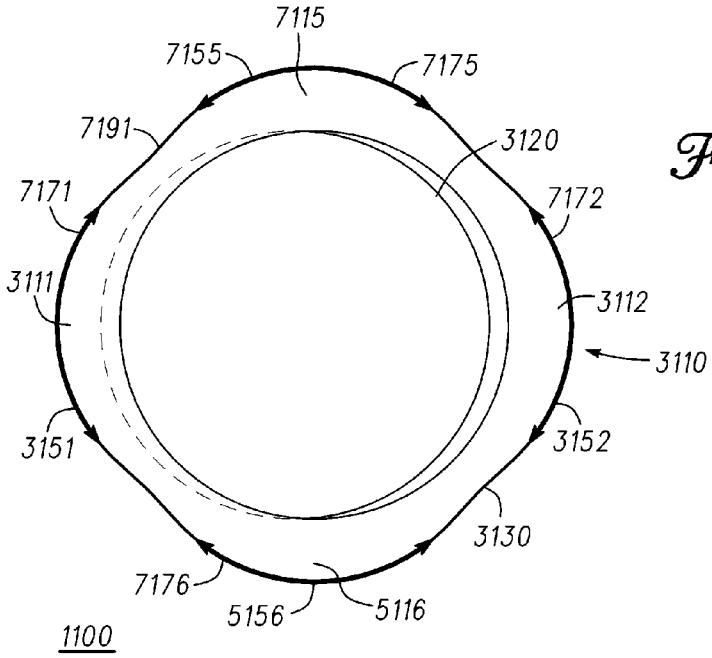
FIG. 7 illustrates a cross-section view of the shaft sleeve along cross-sectional line VII-VII of FIG. 5.

Shaft sleeve 1100 comprises sleeve coupler set 3110 with one or more couplers protruding from sleeve outer wall 3130. FIG. 7 illustrates a cross-section view of shaft sleeve 1100 along line VII-VII of FIG. 5 across sleeve coupler set 3110. FIGS. 3-7 illustrate different views of sleeve coupler set 3110 protruding from sleeve outer wall 3130. In the present example, sleeve coupler set 3110 comprises sleeve couplers 3111, 3112, 5116, and 7115 protruding from sleeve outer wall 3130, where sleeve coupler 3112 lies opposite sleeve coupler 3111 and sleeve coupler 7115 lies opposite sleeve coupler 5116 along perimeter 7191 of sleeve outer wall 3130. As can be seen from FIG. 7, sleeve coupler set 3110 forms alternating concave and convex surfaces about perimeter 7191 in the present embodiment.

The sleeve couplers of sleeve coupler set 3110 comprise arcuate surfaces configured to restrict rotation of shaft sleeve 1100 relative golf club head 101 when shaft sleeve 1100 is inserted and secured in shaft receiver 3200. For example, as seen in FIGS. 3, 5, and 7: (a) sleeve coupler 3111 comprises arcuate surface 3151 curved throughout the outer area of sleeve coupler 3111, (b) sleeve coupler 3112 comprises arcuate surface 3152 curved throughout the outer area of sleeve coupler 3112, (c) sleeve coupler 5116 comprises arcuate surface 5156 curved throughout the outer area of sleeve coupler 5116, and (d) sleeve coupler 7115 comprises arcuate surface 7155 curved throughout the outer area of sleeve coupler 7115.

Figure 8:
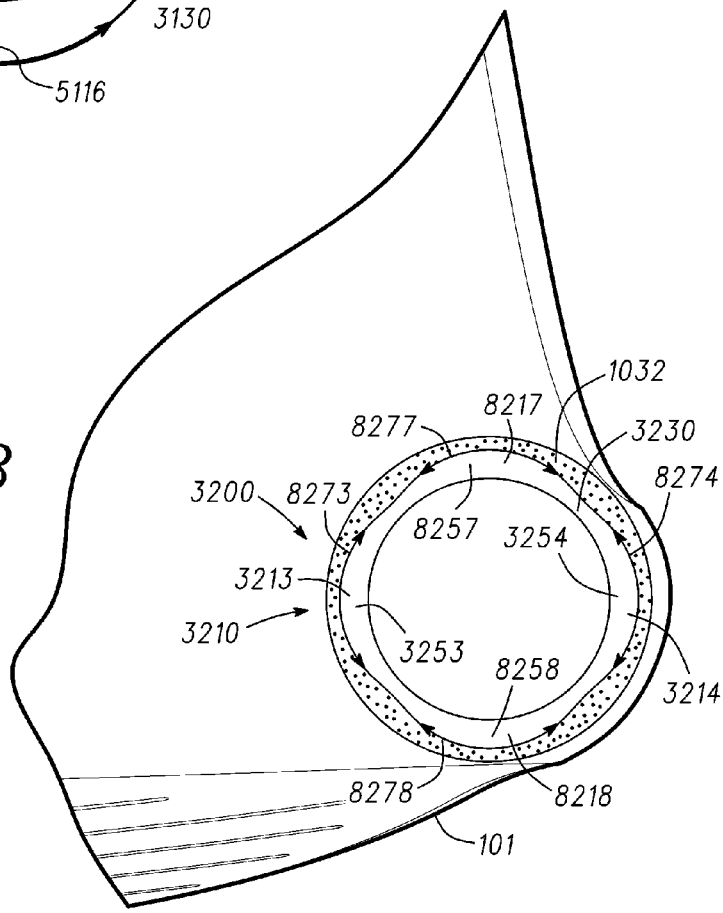
FIG. 8 illustrates a top view of the golf club head of FIG. 1, with the shaft sleeve removed therefrom, showing the shaft receiver from above.

Golf coupling mechanism 1000 also comprises shaft receiver 3200, configured to receive shaft sleeve 1100 as seen in FIGS. 3-4. FIG. 8 illustrates a top view of golf club head 101 with shaft sleeve 1100 removed therefrom, showing shaft receiver 3200 from above. FIG. 9 illustrates a cross-sectional side view of golf club head 101 with shaft sleeve 1100 removed therefrom and along line III-III of FIG. 2, showing a side cross section of shaft receiver 3200.

In the present example, shaft receiver 3200 is integral with hosel 1015 of club head 101, but there can be embodiments where shaft receiver 3200 can be distinct from hosel 1015 and coupled thereto via one or more fastening methods, such as via adhesives, via a screw thread mechanism, and/or via a bolt or rivet. There can also be embodiments where golf club head 101 may comprise a head bore into its crown or top portion, rather than hosel 1015. In such embodiments, the shaft receiver 3200 may also be part of or coupled to, such head bore.

Shaft sleeve 1100 is configured to be inserted into shaft receiver 3200, and can be subdivided in several portions. For example, shaft sleeve 1100 comprises sleeve insertion portion 3160 bounded by sleeve outer wall 3130 and configured to be internal to shaft receiver 3200 when shaft sleeve 1100 is secured in shaft receiver 3200. In the present example, shaft sleeve 1100 also comprises sleeve top portion 3170, configured to remain external to shaft receiver 3200 when shaft sleeve 1100 is secured in shaft receiver 3200. There can be other examples, however, that are devoid of sleeve top portion 3170 and/or with a shaft sleeve similar to shaft sleeve 1100 but configured to be inserted in its entirety into shaft receiver 3200.

Shaft receiver 3200 comprises receiver inner wall 3230 configured to bound sleeve insertion portion 3160 and sleeve outer wall 3130 of shaft sleeve 1100 when inserted therein. Shaft receiver 3200 also comprises receiver coupler set 3210 configured to engage coupler set 3110 of shaft sleeve 1100 to restrict a rotation of shaft sleeve 1100 relative to shaft receiver 3200. In the present embodiment, as can be seen in FIG. 8, receiver coupler set 3210 comprises receiver couplers 3213, 3214, 8217, and 8218 indented into receiver inner wall 3230, with receiver coupler 3213 opposite receiver coupler 3214 and with receiver coupler 8218 opposite receiver coupler 8217.

The receiver couplers of receiver coupler set 3210 in shaft receiver 3200 comprise arcuate surfaces complementary with the arcuate surfaces of sleeve coupler set 3110 of shaft sleeve 1100. For example: (a) receiver coupler 3213 comprises arcuate surface 3253 curved throughout the inner area of receiver coupler 3213 (FIG. 8), where arcuate surface 3253 of receiver coupler 3213 is complementary with arcuate surface 3151 of sleeve coupler 3111 (FIG. 7), (b) receiver coupler 3214 comprises arcuate surface 3254 curved throughout the inner area of receiver coupler 3214 (FIG. 8), where arcuate surface 3254 of receiver coupler 3214 is complementary with arcuate surface 3152 of sleeve coupler 3112 (FIG. 7), (c) receiver coupler 8217 comprises arcuate surface 8257 curved throughout the inner area of receiver coupler 8217 (FIG. 8), where arcuate surface 8257 of receiver coupler 8217 is complementary with arcuate surface 7155 of sleeve coupler 7115 (FIG. 7), and (d) receiver coupler 8218 comprises arcuate surface 8258 curved throughout the inner area of receiver coupler 8218 (FIG. 8), where arcuate surface 8258 of receiver coupler 8218 is complementary with arcuate surface 5156 of sleeve coupler 5116 (FIG. 7).

In the present embodiment, the arcuate surfaces of sleeve coupler set 3110 and of receiver coupler set 3210 are curved throughout their respective sleeve couplers and receiver couplers. FIG. 10 illustrates a side view of a portion of shaft sleeve 1100 and sleeve coupler set 3110. FIG. 11 illustrates a side x-ray view of a portion of shaft receiver 3200 and receiver coupler set 3210. As seen in FIGS. 7 and 10, arcuate surface 5156 of sleeve coupler 5116 comprises horizontal radius of curvature 7176, arcuate surface 3151 of sleeve coupler 3111 comprises horizontal radius of curvature 7171, arcuate surface 3152 of sleeve coupler 3112 comprises horizontal radius of curvature 7172, and arcuate surface 7155 of sleeve coupler 7115 comprises horizontal radius of curvature 7175 in the present example. Also in the present example, the arcuate surfaces of sleeve coupler set 3110 comprise vertical taperings that decrease in thickness towards sleeve bottom end 3192 of shaft sleeve 1100 and towards sleeve axis 5150 (FIGS. 5-6). For example, as seen in FIG. 10, arcuate surface 5156 of sleeve coupler 5116 comprises vertical tapering 10186, arcuate surface 3151 of sleeve coupler 3111 comprises vertical tapering 10181, and arcuate surface 3152 of sleeve coupler 3112 comprises vertical tapering 10182. Although not shown in FIG. 10, arcuate surface 7155 of sleeve coupler 7115 also comprises a vertical tapering similar to vertical tapering 10186 of sleeve coupler 5116.

With respect to receiver coupler set 3210 of shaft receiver 3200, as seen in FIGS. 8 and 1, arcuate surface 8258 of receiver coupler 8218 comprises horizontal radius of curvature 8278 complementary with horizontal radius of curvature 7176 of sleeve coupler 5116 (FIGS. 7, 10), arcuate surface 3253 of receiver coupler 3213 comprises horizontal radius of curvature 8273 complementary with horizontal radius of curvature 7171 of sleeve coupler 3111 (FIG. 7), arcuate surface 3254 of receiver coupler 3214 comprises horizontal radius of curvature 8274 complementary with horizontal radius of curvature 7172 of sleeve coupler 3112 (FIG. 7), and arcuate surface 8257 of receiver coupler 8217 comprises horizontal radius of curvature 8277 complementary with horizontal radius of curvature 7175 of sleeve coupler 7115 (FIG. 7) in the present example.

Also in the present example, the arcuate surfaces of receiver coupler set 3210 comprise vertical taperings complementary to the vertical taperings of the arcuate surfaces of sleeve coupler set 3110. For example, as seen in FIG. 11, arcuate surface 8258 of receiver coupler 8218 comprises vertical tapering 11288 complementary with vertical tapering 10186 of sleeve coupler 5116 (FIG. 10), arcuate surface 3253 of receiver coupler 3213 comprises vertical tapering 11283 complementary with vertical tapering 10181 of sleeve coupler 3111 (FIG. 10), and arcuate surface 3254 of receiver coupler 3214 comprises vertical tapering 11284 complementary with vertical tapering 10182 of sleeve coupler 3112 (FIG. 10). Although not shown in FIG. 11, arcuate surface 8257 of receiver coupler 8217 also comprises a vertical tapering similar to vertical tapering 11288 of receiver coupler 8218 and complementary to the vertical tapering of sleeve coupler 7115.

In the present embodiment, the vertical taperings of the arcuate surfaces of sleeve coupler set 3110 are substantially linear, decreasing in a substantially straight line as can be seen in the profile view of vertical taperings 10181 and 10182 for sleeve couplers 3111 and 3112 in FIG. 10. Similarly, the vertical taperings of the arcuate surfaces of receiver coupler set 3210 are substantially linear, as can be seen in the profile view of vertical taperings 11283 and 11284 for receiver couplers 3213 and 3214 in FIG. 11. In the same or other examples, the substantially linear vertical taperings of the arcuate surfaces of sleeve coupler set 3110 and of receiver coupler set 3210 may be considered to comprise a large or infinite vertical radius of curvature yielding a substantially straight line.

Figure 12:
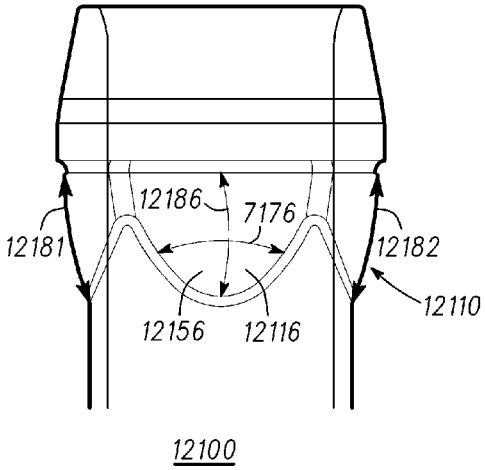
FIG. 12 illustrates a side view of a portion of a sleeve coupler set of a shaft sleeve similar to the shaft sleeve of FIGS. 1-7, and 10.
Figure 13:
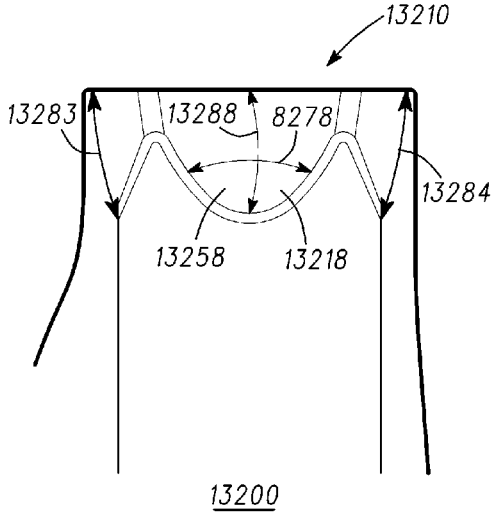
FIG. 13 illustrates a side x-ray view of a portion a receiver coupler set of a shaft receiver similar to the shaft receiver of FIGS. 1-4, 8-9, and 1.

There can be other embodiments, however, where the vertical taperings of the sleeve couplers and/or the receiver couplers need not be linear. FIG. 12 illustrates a side view of a portion of shaft sleeve 12100 with sleeve coupler set 12110. FIG. 13 illustrates a side x-ray cross-sectional view of shaft receiver 13200 with receiver coupler set 13210.

Shaft sleeve 12100 can be similar to shaft sleeve 1100 (FIGS. 1-7, 10), and shaft receiver 13200 can be similar to shaft receiver 3200 (FIGS. 3-4, 8, 10). Sleeve coupler set 12110 differs from sleeve coupler set 3110, however, by comprising vertical taperings that are not linear. For example, sleeve coupler set 12110 comprises vertical taperings 12186, 12181, and 12182 that are curved rather than linear, and can comprise respective vertical radii of curvature. Similarly, receiver coupler set 13210 comprises vertical taperings 13288, 13283, and 13284 that are curved rather than linear, and comprise respective vertical radii of curvature complementary with the radii of curvature of sleeve coupler set 12110. Accordingly, the sleeve couplers of sleeve coupler set 12110 and the receiver couplers of receiver coupler set 13120 are each curved horizontally and vertically throughout their respective surface areas. For example, any horizontal line tangential to any point of a total surface of sleeve coupler 12116 is non-tangential to any other point of the total surface of sleeve coupler 12116. In the same or other embodiments, the total surface of each sleeve coupler of sleeve coupler set 12110, and the total surface of each receiver coupler of receiver coupler set 13120 is each curved throughout and in all directions.

The different sleeve couplers and receiver couplers of the present disclosure may comprise respective curvatures within certain ranges. For example, with respect to FIGS. 7 and 10, horizontal radii of curvature 7171, 7172, 7175, and 7176 of sleeve coupler set 3110 are each of approximately 0.175 inches (4.45 millimeters (mm)), but there can be embodiments where they could range from approximately 0.1 inches (2.54 mm) to approximately 0.225 inches (5.715 mm). With respect to FIGS. 8 and 1, horizontal radii of curvature 8273, 8274, 8277, and 8278 of receiver coupler set 3210 can be complementarily the same or similar to horizontal radii of curvature 7171, 7172, 7175, and 7176 (FIGS. 7, 10), respectively. In addition, the horizontal radii of curvature for sleeve coupler set 12110 and for receiver coupler set 13210 in the embodiment of FIGS. 12-13 can also be similar to those described above with respect to the embodiment of FIGS. 1-11 for sleeve coupler set 3110 and/or receiver coupler set 3210.

As previously described, in the embodiment of FIGS. 1-11, the vertical taperings of sleeve coupler set 3110 (FIG. 10) and of receiver coupler set 3210 (FIG. 11) can comprise vertical radii of curvature approximating infinity, thereby yielding substantially straight lines. In the embodiment of FIGS. 12-13, the vertical taperings of sleeve coupler set 12110 (FIG. 12) and of receiver coupler set 13210 (FIG. 13) comprise more pronounced vertical radii of curvature. As an example the vertical radius of curvature for vertical tapering 12186 of sleeve coupler 12116 (FIG. 12) is of approximately 0.8 inches (20.32 mm), but there can be embodiments where it could range from approximately 0.4 inches (10.16 mm) to 2 inches (50.8 mm). The vertical radii of curvature for other similar portions of sleeve coupler set 12110 can also be in the same range described for vertical tapering 12186. In addition, the vertical radii of curvature for receiver coupler set 13210 (FIG.

13) can be complementarily the same or similar to the vertical radii of curvature described for sleeve coupler set 12110 (FIG. 12).

In some examples, the arcuate surfaces of the sleeve couplers and/or of the receiver couplers may comprise portions of geometric structures. For instance, the arcuate surface of sleeve coupler 12116 (FIG. 12) can comprise a quadric surface, and the arcuate surface of receiver coupler 13218 (FIG. 13) can comprise a quadric surface complementary to the arcuate surface of sleeve coupler 12116. In such examples, the quadric surface of sleeve coupler 12116 and of receiver coupler 13218 can comprise, for example, a portion of a paraboloid surface or a portion of a hyperboloid surface. There can also be examples with sleeve couplers and receiver couplers whose quadric arcuate surfaces can comprise a portion of a degenerate quadric surface, such as a portion of a conical surface. Such examples can be similar to those of FIGS. 10-11 with respect to sleeve coupler set 3110 and receiver coupler set 3200.

In the embodiments of FIGS. 10-11 and of FIGS. 12-13, the arcuate surfaces of the sleeve couplers of sleeve coupler set 3110 (FIG. 10) and/or 12110 (FIG. 12), and the arcuate surfaces of the receiver couplers of receiver coupler set 3210 (FIG. 11) and/or 13210 (FIG. 13), can be configured to be devoid of any inflection point, such as to be continuously curved. In the same or other embodiments, such arcuate surfaces can also be configured to be edgeless (except for their respective perimeter). For example, the total surface area of sleeve coupler 5116 (FIG. 10) is edgeless with respect to any portion of its total surface area within its perimeter. In addition, the total surface area of receiver coupler 8218 (FIG. 11) also is edgeless with respect to any portion of its total surface area within its perimeter. Similar edgeless attributes are also shared by sleeve coupler 12110 (FIG. 12) and receiver coupler 13218 (FIG. 13). The characteristics described above can permit the contact area to be maximized when sleeve couplers seat against receiver couplers to restrict rotation of their shaft sleeves relative to their respective shaft receivers.

As can be seen in FIGS. 3-7 and 10, sleeve coupler set 3110 protrudes from a top section of sleeve outer wall 3130. Similarly, as can be seen in FIGS. 3-4, 8-9, and 1, receiver coupler set 3210 is indented into a top section of receiver inner wall 3230. There can be other embodiments, however, where sleeve coupler set 3110 and receiver coupler set 3210 may be located elsewhere. For instance, sleeve coupler set 3110 and receiver coupler set 3210 may be located at or towards bottom sections or mid sections of shaft sleeve 1100 and shaft receiver 3200, respectively. In the same or other embodiments, the shape of sleeve coupler set 3110 and receiver coupler set 3210 could be reversed such that sleeve coupler set 3110 is recessed into sleeve outer wall 3130 and receiver coupler set 3210 protrudes from receiver inner wall 3230. The apparatus, methods, and articles of manufacture described herein are not limited in this regard.

As can be seen in the cross section presented in FIG. 3, golf coupling mechanism 1000 also comprises securing fastener 3400 configured to secure shaft sleeve 1100 to shaft receiver 3200. In the present example, securing fastener 3400 comprises a bolt configured to couple, via a passageway at a bottom of shaft receiver 3200, with sleeve bottom end 3192 of shaft sleeve 1100. Securing fastener 3400 is configured to couple with sleeve bottom end 3192 via a screw thread mechanism. As the screw thread mechanism is tightened, securing fastener 3400 is configured to pull shaft sleeve 1100 towards the bottom end of shaft receiver 3200, thereby causing the arcuate surfaces of sleeve coupler set 3110 to seat against the arcuate surfaces of receiver coupler set 3210.

In the present embodiment, securing fastener 3400 comprises retainer element 3450 coupled thereto to restrict or at least inhibit securing fastener 3400 from being fully removed from shaft receiver 3200 when decoupled from shaft sleeve 1100. Retainer element 3450 comprises a washer located within shaft receiver 3200 and coupled around the threads of securing fastener 3400. Retainer element 3450 can be configured to flexibly engage the threads of securing fastener 3400 in the present embodiment, such as to permit positioning thereof along the threads of securing fastener 3400 by ramming securing fastener 3400 through retainer element 3450, and such as to remain substantially in place once positioned along the threads of securing fastener 3400. Retainer element 3450 can thus retain an end of securing fastener 3400 within shaft receiver 3200 after shaft sleeve 1100 is removed therefrom, and can permit insertion of the end of securing fastener 3400 into sleeve bottom end 3192. In some examples, retainer element 3450 can comprise a material such as a nylon material or other plastic material more flexible than the material of securing fastener 3400.

In other examples, the bore through which securing fastener 3400 enters shaft receiver 3200 may comprise threading corresponding to that of securing fastener 3400, where such threading can thereby serve as the retainer element. IN these other examples, retainer element 3450 can be omitted.

Sleeve coupler set 3110 and receiver coupler set 3210 are configured such that at least a majority of their respective arcuate surfaces seat against each other when shaft sleeve 1110 is secured in shaft receiver 3200 by securing fastener 3400. For example, in the embodiment of FIGS. 10-11, when seated against each other, at least a majority of a total surface of sleeve coupler 5116 and a majority a total surface of receiver coupler 8218 contact each other and restrict rotation of shaft sleeve 1100 relative to shaft receiver 3200. As another example, in the embodiment of FIGS. 11-12, when seated against each other, a majority of a total surface of sleeve coupler 12116 and a majority of a total surface of receiver coupler 13218 also contact each other to restrict rotation. In the same or other examples, the contact area defined by the interface between an individual sleeve coupler of sleeve coupler set 3110 (FIG. 10) or 12110 (FIG. 12) and an individual receiver coupler of receiver coupler set 3210 (FIG. 11) or 13210 (FIG. 13) may be of approximately 51% to approximately 95% of a total surface of the individual receiver coupler or the individual sleeve coupler. Such contact area may be even greater in some embodiments, such as to substantially approach or equal the total surface of the individual receiver coupler and/or of the individual sleeve coupler. There can also be examples where, when the arcuate surfaces of the sleeve couplers of sleeve coupler set 3110 (FIG. 10) or 12110 (FIG. 12) seat against the arcuate surfaces of the receiver couplers of receiver coupler set 3200 (FIG. 11) or 13210 (FIG. 13), normal forces are exerted against each other across the respective contact areas.

In the present example, when securing fastener 3400 secures shaft sleeve 1100 in shaft receiver 3200, sleeve top portion 3170 remains external to shaft receiver 3200, with bottom end 3171 of sleeve top portion 3170 spaced away from a top end of shaft receiver 3200 by the seating of sleeve coupler set 3110 against receiver coupler set 3210. Such built-in spacing eases manufacturing tolerances, ensuring that sleeve coupler set 3110 can properly seat against receiver coupler set 3210.

In the same or other examples, a portion of one or more of the sleeve couplers of sleeve coupler set 3110 may protrude past the top end of shaft receiver 3200. There can also be examples where one or more of the sleeve couplers of sleeve coupler set 3110 may extend past the bottom end of one or more of the receiver couplers of receiver coupler set 3210. In other examples, one or more of the receiver couplers of receiver coupler set may extend past the bottom end of one or more of the sleeve couplers of sleeve coupler set 3110. Some of the features described above may be designed into golf coupling mechanism 1000 to ease the required manufacturing tolerances while still permitting proper seating of sleeve coupler set 3110 against receiver coupler set 3210.

Figure 14:
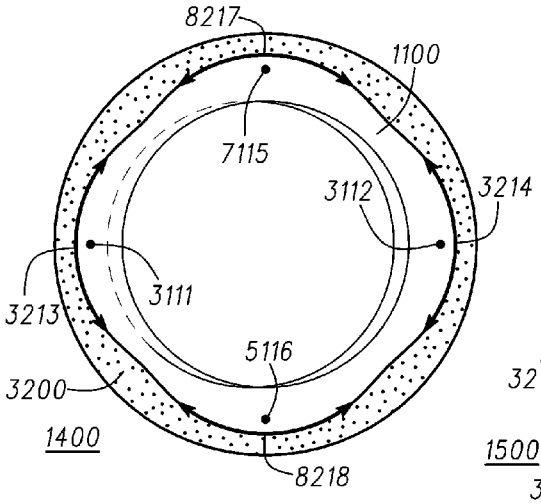
FIG. 14 illustrates a top cross-sectional view of the golf coupling mechanism in a first configuration, with respect to the viewpoint of cross-sectional line XIV-XIV of FIG. 4.

FIG. 14 illustrates a top cross-sectional view of golf coupling mechanism 1000 in configuration 1400, with respect to the viewpoint of line XIV-XIV of FIG. 4. Golf coupling mechanism 1000 is shown in FIGS. 3-4 and 14 in configuration 1400, where sleeve couplers 3111, 7115, 3112, and 5116 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1400 in FIG. 14 can comprise a first lie angle and a first loft angle between shaft bore axis 6150 (FIG. 6) and shaft receiver 3200 (FIGS. 3-4, 8-9) and/or between shaft 102 (FIG. 1) and golf club head 101 (FIG. 1).

Figure 15:
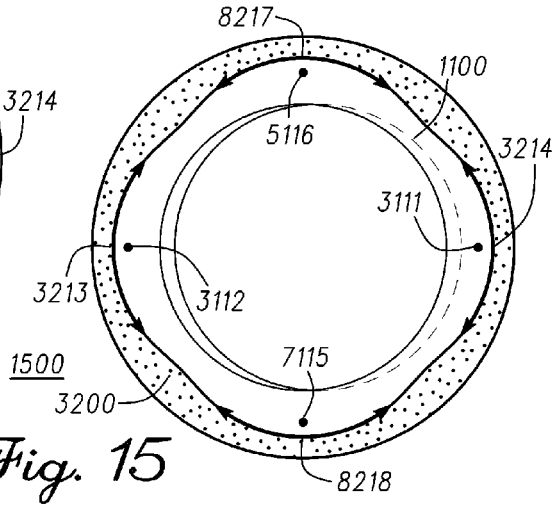
FIG. 15 illustrates a top cross-sectional view of the golf coupling mechanism in a second configuration, with respect to the viewpoint of cross-sectional line XIV-XIV of FIG. 4.

FIG. 15 illustrates a top cross-sectional view of golf coupling mechanism 1000 in configuration 1500, with respect to the viewpoint of line XIV-XIV of FIG. 4. In configuration 1500, sleeve couplers 3112, 5116, 3111, and 7115 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1500 in FIG. 15 can comprise a second lie angle and a second loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 16 illustrates a top cross-sectional view of golf coupling mechanism 1000 in configuration 1600, with respect to the viewpoint of line XIV-XIV of FIG. 4. In configuration 1600, sleeve couplers 7115, 3112, 5116, and 3111 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1600 in FIG. 16 will comprise a third lie angle and a third loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 17 illustrates a top cross-sectional view of golf coupling mechanism 1000 in configuration 1700, with respect to the viewpoint of line XIV-XIV of FIG. 4. In configuration 1700, sleeve couplers 5116, 3111, 7115, and 3112 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1700 in FIG. 17 will comprise a fourth lie angle and a fourth loft angle between shaft bore axis 6150 (FIG. 6) and shaft receiver 3200 (FIGS. 3-4, 8-9) and/or between shaft 102 (FIG. 1) and golf club head 101 (FIG. 1).

Depending on the angle of shaft bore axis 6150 with respect to sleeve axis 5150 and sleeve coupler set 3110, different lie and loft angle alignments may be attained via the configurations shown in FIGS. 14-17. For example, in the present embodiment, as can be seen in FIG. 6, the angle between shaft bore axis 6150 and sleeve axis 5150 causes the bottom of shaft bore 3120 to point towards sleeve coupler 3111, such that shaft 102 (FIG. 1) will lean towards sleeve coupler 3112 when inserted into shaft sleeve 1100.

Accordingly, in configuration 1400 (FIG. 14), the first lie angle may comprise a lower lie angle, and the first loft angle may comprise a neutral or middle loft angle. As an example, the first lie angle can be set to tilt the grip end of shaft 102 towards the heel of golf club head 101 (FIG. 1) by approximately 0.2 degrees to approximately 4 degrees, thereby decreasing the lie angle of the golf club in configuration 1400. The first loft angle, being neutral in the present example, does not affect the tilt of shaft 102 in configuration 1400.

In configuration 1500 (FIG. 15), the second lie angle may comprise a higher lie angle, and the second loft angle may comprise a neutral or middle loft angle, which may be similar or equal to the first loft angle of configuration 1400 (FIG. 14). As an example, second lie angle can be set to tilt the grip end of shaft 102 towards the toe of golf club head 101 (FIG. 1) by approximately 0.2 degrees to approximately 4 degrees, thereby increasing the lie angle of the golf club in configuration 1500. The second loft angle, being neutral in the present example, does not affect the tilt of shaft 102 in configuration 1500.

In configuration 1600 (FIG. 16), the third loft angle may comprise a lower loft angle, and the third lie angle may comprise a neutral or middle lie angle. As an example, the third loft angle can be set to tilt the grip end of shaft 102 towards the rear of golf club head 101 (FIG. 1) by approximately 0.2 degrees to approximately 4 degrees, thereby decreasing the loft angle of the golf club in configuration 1600. The third lie angle, being neutral in the present example, does not affect the tilt of shaft 102 in configuration 1600.

In configuration 1700 (FIG. 17), the fourth loft angle may comprise a higher loft angle, and the fourth lie angle may comprise a neutral or middle lie angle, which may be similar or equal to the third lie angle of configuration 1600 (FIG. 16). As an example, the fourth loft angle can be set to tilt the grip end of shaft 102 towards the front or strike face of golf club head 101 (FIG. 1) by approximately 0.2 degrees to approximately 4 degrees, thereby increasing the loft angle of the golf club in configuration 1700. The fourth lie angle, being neutral in the present example, does not affect the tilt of shaft 102 in configuration 1700.

Other lie and loft angle relationships may be configured in other embodiments by altering the angle and/or orientation of shaft bore axis 6150 (FIG. 6) with respect to sleeve axis 5150 (FIG. 6) of shaft sleeve 1100. Furthermore, as seen from FIGS. 14-17, sleeve couplers 3111, 3112, 5116, and 7115 are symmetric with each other, and receiver couplers 3213, 3214, 8217, and 8218 are also symmetric with each other. In a different embodiment, only opposite ones of the sleeve couplers and the receiver couplers may be symmetric with each other such that only two (and not four) different lie and loft angle combinations are permitted.

The different features described above for the golf coupler mechanisms of FIGS. 1-17 can also impart several performance benefits to the golf clubs on which they are used, when compared to other golf club heads with adjustable shaft coupling mechanisms. For example, because of the small number of parts required, and/or because receiver coupler set 3210 is located only towards the top end of shaft receiver 3200 (FIG. 3), hosel diameter 1031 of hosel 1015 (FIG. 1) can be maintained to a minimum and/or relatively unchanged from a hosel diameter of a corresponding regular golf club head. In some examples, hosel diameter 1031 can be of less than approximately 0.55 inches (approximately 14 mm), such as of approximately 0.53 inches (approximately 13.46 mm). In addition, top wall thickness 9250 (FIG. 9) of shaft receiver 3200 can be minimized as shown at receiver top end 1032 of shaft receiver 3200. In some examples, top wall thickness 9250 can be of approximately 0.035 inches (approximately 0.89 mm) or less, such as of approximately 0.024 inches (approximately 0.61 mm).

Figure 19:
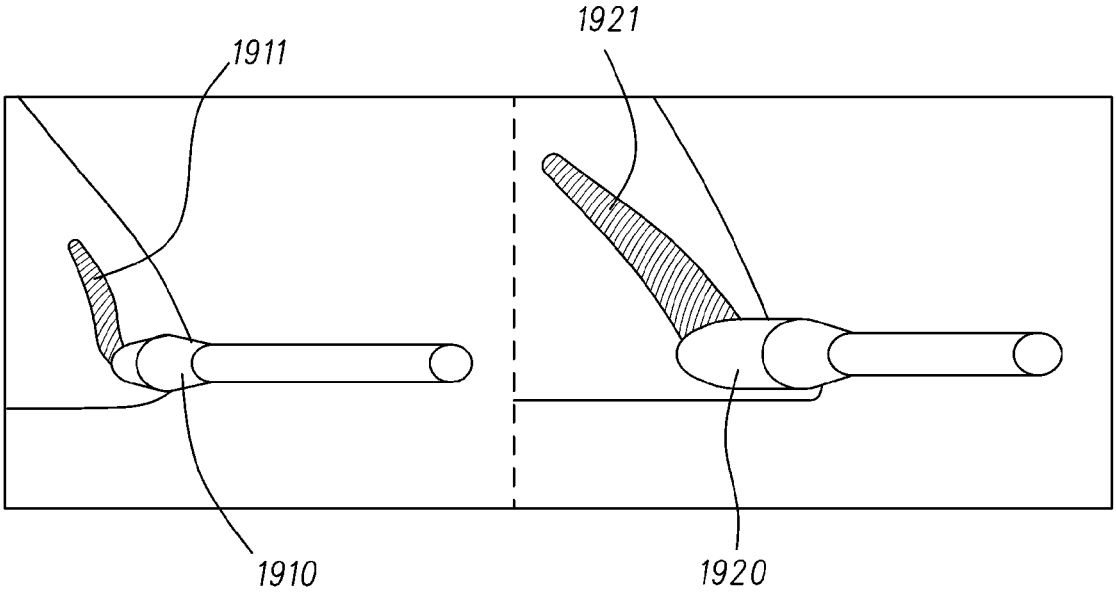
FIG. 19 illustrates a comparison of stagnant drag wake areas for respective hosels of different golf club heads 1910 and 1920.
Figure 20:
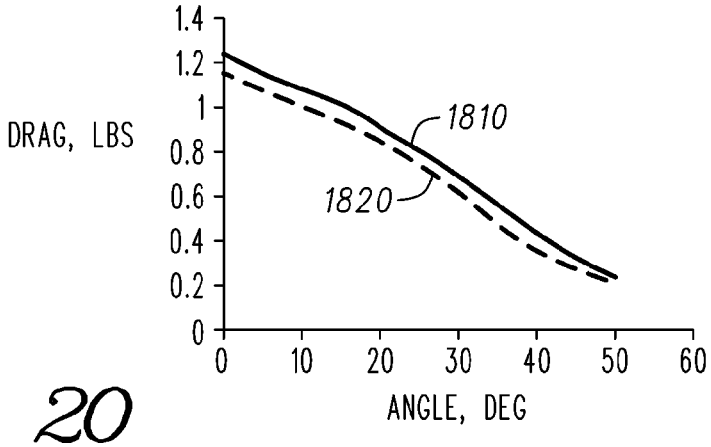
FIG. 20 illustrates a chart of drag as a function of open face angle with respect to the hosel diameters the golf club heads of FIG. 19.

Because hosel diameter 1031 can be minimized as described above, the aerodynamic characteristics of golf club head 101 can be improved as a result of the reduced aerodynamic drag from hosel 1015. FIG. 19 illustrates a comparison of stagnant drag wake areas 1911 and 1921 for respective hosels of golf club heads 1910 and 1920, where golf club head 1910 comprises a hosel diameter of approximately 0.5 inches, and where golf club head 1920 comprises a larger hosel diameter of approximately 0.62 inches. In some examples, golf club head 1910 can be similar to golf club head 101 (FIGS. 1-4, 8-9). As seen in FIG. 19, the larger hosel diameter of club head 1920 creates larger stagnant drag wake area 1921 downstream of its hosel, leading to higher values of aerodynamic drag when compared to the smaller stagnant drag wake area 1911 of club head 1910. FIG. 20 illustrates a chart of drag as a function of open face angle with respect to the hosel diameters golf club heads 1910 and 1920. In some examples, club head 1910 can also comprise a golf club shaft of reduced shaft thickness, such as a shaft thickness of approximately 0.335 inches (approximately 8.5 mm). In the same or other examples, for open-faced orientations of up to 50 degrees, such difference in hosel diameter can amount for up to approximately 0.1 pounds less drag resistance for golf club head 1910 when compared to the larger drag of golf club head 1920. In the same or other examples, the drag of golf club head 1910 can range from approximately 1.2 pounds at an approximately square orientation, to approximately 0.2 pounds at an open-faced orientation of approximately 50 degrees.

In the same or other embodiments, the mass and/or mass ratio of the golf coupler mechanisms of FIGS. 1-17 can be minimized with respect to their respective golf club heads when compared to other golf club heads with adjustable shaft coupling mechanisms. For instance, in examples where golf club head 101 (FIGS. 1-4, 8-9) comprises a driver-type golf club head, the different elements of club head 101 can comprise mass characteristics similar to those summarized below in Table 1.

TABLE 1

Sample Mass Characteristics for Driver-Type Golf Club Head

| | Exemplary Driver Head | Ranges for Driver Heads |
|---|---|---|
| Mass of Clubhead 101 (disassembled) | 192 grams (approx.) | 185-205 grams (approx.) |
| Mass of Sleeve 1100 | 5.2 grams (approx.) | <6 grams (approx.) |
| Mass of Sleeve 1100 + Securing Fastener 3400 | 6.8 grams (approx.) | <7.5 grams (approx.) |
| Total Assembled Clubhead Mass | 198.8 grams (approx.) | 188-213 grams (approx.) |

In such examples, the mass ratios for the golf coupler mechanism 1000 relative to assembled club head 101 can be very low, as summarized below in Table 2.

TABLE 2

Sample Mass Ratios for Driver-Type Golf Club Head

| | Exemplary Driver Head | Ranges for Driver Heads |
|---|---|---|
| $\frac{\text{Mass of Sleeve}}{\text{Mass of disassembled Clubhead}}$ | 2.7% (approx.) | <3% (approx.) |
| $\frac{\text{Mass of Sleeve}}{\text{Mass of assembled Clubhead}}$ | 2.6% (approx.) | <3% (approx.) |
| $\frac{\text{Mass of (Sleeve + Securing Fastener)}}{\text{Mass of disassembled Clubhead}}$ | 3.5% (approx.) | <4% (approx.) |
| $\frac{\text{Mass of (Sleeve + Securing Fastener)}}{\text{Mass of assembled Clubhead}}$ | 3.4% (approx.) | <4% (approx.) |

In other examples, such as where golf club head 101 (FIGS. 1-4, 8-9) comprises a fairway-wood-type golf club head, the different elements of club head 101 can comprise mass characteristics similar to those summarized below in Table 3.

TABLE 3

Sample Mass Characteristics for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Clubhead 101 (disassembled) | 205 grams (approx.) | 209 grams (approx) | 213 grams (approx.) | 200-225 grams (approx.) |
| Mass of Sleeve 1100 | 5.2 grams (approx.) | 5.2 grams (approx.) | 5.2 grams (approx.) | <6 grams (approx.) |
| Mass of Sleeve 1100 + Securing Fastener 3400 | 6.8 grams (approx.) | 6.8 grams (approx.) | 6.8 grams (approx.) | <7.5 grams (approx.) |
| Total Assembled Clubhead Mass | 211.8 (approx.) | 215.8 (approx.) | 219.8 (approx.) | 203-233 grams (approx.) |

In such examples, the mass ratios for the golf coupler mechanism 1000 relative to assembled club head 101 can be very low, as summarized below in Table 4.

TABLE 4

Sample Mass Ratios for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Sleeve / Mass of disassembled Clubhead | 2.54% (approx.) | 2.48% (approx.) | 2.44% (approx.) | <2.8% (approx.) |
| Mass of Sleeve / Mass of assembled Clubhead | 2.46% (approx.) | 2.41% (approx.) | 2.36% (approx.) | <2.8% (approx.) |
| Mass of (Sleeve + Securing Fastener) / Mass of disassembled Clubhead | 3.32% (approx.) | 3.25% (approx.) | 3.19% (approx.) | <3.5% (approx.) |
| Mass of Sleeve / Mass of disassembled Clubhead | 3.21% (approx.) | 3.16% (approx.) | 3.10% (approx.) | <3.5% (approx.) |

There can be examples where the mass, dimension, and/or location characteristics described above can provide benefits and/or flexibility with respect to the mass distribution and/or location of the center of gravity for the golf club head. For example, in embodiments where club head 101 (FIGS. 1-4, 8-9) comprises a driver-type golf club head, center of gravity 1150 (FIG. 1) of shaft sleeve 1100 can be configured to be located at distance 1159 (FIG. 1) of less than approximately 1.72 inches (approximately 43.7 mm) above the exterior bottom end of the sole of club head 101. In the same or other examples, center of gravity 1150 of shaft sleeve 1100 can be configured to be located at distance 1059 (FIG. 1) of less than approximately 0.59 inches (approximately 15.0 mm) above center of gravity 1050 (FIG. 1) of assembled golf club head 101.

In other examples, such as in embodiments where club head 101 (FIGS. 1-4, 8-9) comprises a fairway-wood-type golf club head, center of gravity 1150 (FIG. 1) of shaft sleeve 1100 can be configured to be located at distance 1159 (FIG. 1) of less than approximately 1.35 inches (approximately 34.3 mm) above the exterior bottom end of the sole of club head 101. In the same or other examples, center of gravity 1150 of shaft sleeve 1100 can be configured to be located at distance 1059 (FIG. 1) of less than approximately 0.74 inches (approximately 18.8 mm) above center of gravity 1050 (FIG. 1) of assembled golf club head 101.

There can also be examples, such as seen in FIG. 1, where receiver top end 1032 is at the top of hosel 1015 and is configured to remain below the upper end of crown 1017 of golf club head 101. Hosel 1015 can be devoid of a cylindrical external top section in the same or other embodiments, where crown 1017 can transition to the substantially circular external perimeter at receiver top end 1032 of hosel 1015 without defining an cylindrical external shape for hosel 1015. Such features can permit location of the center of gravity of shaft sleeve 1100 closer to the center of gravity of assembled golf club head 101.

Backtracking though the figures, FIG. 18 illustrates a flowchart for a method 18000, which can be used to provide, form, and/or manufacture a golf coupler mechanism in accordance with the present disclosure. In some examples, the golf coupler mechanism can be similar to golf coupler mechanism 1000 of FIGS. 1-11 and 14-16, or the golf coupler mechanism of FIGS. 12-13.

Method 18000 comprises block 18100 for providing a shaft sleeve to couple with an end of a golf club shaft and comprising a sleeve arcuate coupler set. In some examples, the shaft sleeve can be similar to shaft sleeve 1100 (FIGS. 1-7, 10, 14-16) and/or to shaft sleeve 12100 (FIG. 12), and the golf club shaft can be similar to golf club shaft 102 (FIGS. 1, 5). In the same or other examples, the sleeve arcuate coupler set can be similar to sleeve coupler set 3110 (FIGS. 3-7, 10, 14-17) and/or to sleeve coupler set 12110 (FIG. 12).

Block 18200 of method 18000 comprises providing a shaft receiver of a golf club head, comprising a receiver arcuate coupler set configured to couple with the sleeve arcuate coupler set of the shaft sleeve. In some examples, the shaft receiver can be similar to shaft receiver 3200 (FIGS. 3-4, 8-9, 11, 14-17) and/or to shaft receiver 13200 (FIG. 13). The receiver arcuate coupler set can be similar to receiver coupler set 3210 (FIGS. 3-4, 8-9, 11, 14-17) and/or to receiver coupler set 13210 (FIG. 13).

Block 18300 of method 18000 comprises providing a securing fastener configured to secure the shaft sleeve to the shaft receiver. In some examples, the securing fastener can be similar to securing fastener 3400 (FIGS. 3-4). The securing fastener can be configured to pull the shaft sleeve towards the shaft receiver to seat the sleeve arcuate coupler set against the receiver arcuate coupler set.

In some examples, one or more of the different blocks of method 18000 can be combined into a single block or performed simultaneously, and/or the sequence of such blocks can be changed. For example, in some embodiments, blocks 18200 and 18300 may be combined if desired. In the same or other examples, some of the blocks of method 18000 can be subdivided into several sub-blocks. As an example, block 18100 may comprise a sub-block for forming horizontal radii of curvature for the arcuate surfaces of the sleeve couplers of the sleeve arcuate coupler set, and a sub-block for forming vertical taperings for the arcuate surfaces of the sleeve couplers of the sleeve arcuate coupler set. There can also be examples where method 18000 can comprise further or different blocks. As an example, method 18000 may comprise another block for providing the golf club head for the shaft receiver of block 18200, and/or another block for providing the shaft for the shaft sleeve of block 18100. In addition, there may be examples where method 18000 can comprise only part of the steps described above. For instance, block 18300 may be optional in some implementations. Other variations can be implemented for method 18000 without departing from the scope of the present disclosure.

Although the golf coupling mechanisms and related methods herein have been described with reference to specific embodiments, various changes may be made without departing from the spirit or scope of the present disclosure. As an example, there may be embodiments where sleeve coupler set 3110 (FIGS. 3-7, 10, 14-17) and/or sleeve coupler set 12110 (FIG. 12) can comprise only two sleeve couplers, and where receiver coupler set 3210 (FIGS. 3-4, 8-9, 11, 14-17) receiver coupler set 13210 (FIG. 13) can comprise only two receiver couplers. In such embodiments, only two configurations may be possible between the shaft sleeve and the shaft receiver, and the golf coupler set may permit adjustment between two lie angles or two loft angles. Of course, there can also be embodiments with sleeve coupler sets having three, five, six, seven, eight, or more sleeve couplers, and receiver coupler sets having three, five, six, seven eight, or more receiver couplers, with corresponding increases in the number of possible lie and loft angle combinations.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf coupling mechanisms and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a club head body comprising a hosel;

a shaft sleeve insertable into the hosel and configured to repositionably couple a golf club shaft with the hosel;

a securing fastener configured to secure the shaft sleeve in the hosel;

an assembled club head mass of the club head body, the shaft sleeve, and the securing fastener when the club head body is coupled to the shaft sleeve and the securing fastener; and a disassembled club head mass when the club head body is decoupled from the shaft sleeve and the securing fastener;

wherein:

the hosel comprises:

a hosel bore configured to receive the shaft sleeve;

the shaft sleeve comprises:

a sleeve mass; and a sleeve bore configured to receive an end of the golf club shaft;

the securing fastener comprises a securing fastener mass;

the sleeve mass is less than approximately 3% of the assembled club head mass;

the club head comprises a driver-type club head;

the shaft sleeve comprises a shaft sleeve center of gravity; and when the golf club head is at an address position, with the shaft sleeve secured in the hosel:

the shaft sleeve center of gravity is located at a sleeve CG vertical distance of less than approximately 43.7 mm relative to a sole bottom end of a sole of the golf club head.

2. The golf club head of claim 1, wherein:

the sleeve mass is less than or equal to approximately 2.7% of the disassembled club head mass.

3. The golf club head of claim 1, wherein:

a sleeve combined mass comprises the sleeve mass and the securing fastener mass; and the sleeve combined mass is less than approximately 4% of the disassembled club head mass.

4. The golf club head of claim 1, wherein:

a sleeve combined mass comprises the sleeve mass and the securing fastener mass; and the sleeve combined mass is less than or equal to approximately 3.5% of the disassembled club head mass.

5. The golf club head of claim 1, wherein:

the disassembled club head mass is less than or equal to approximately 205 grams;

the sleeve mass is less than approximately 6 grams;

a sleeve combined mass, comprising the sleeve mass and the securing fastener mass, is less than approximately 7.5 grams; and the assembled club head mass is less than or equal to approximately 213 grams.

6. The golf club head of claim 1, wherein:
the disassembled club head mass is less than approximately 192 grams;
the sleeve mass is less than or equal to approximately 5.2 grams;
a sleeve combined mass, comprising the sleeve mass and the securing fastener mass, is less than or equal to approximately 6.8 grams; and
the assembled club head mass is less than or equal to approximately 199 grams.

7. The golf club head of claim 1, wherein:
the hosel comprises a hosel top end with a hosel outer perimeter; and
the hosel outer perimeter comprises a hosel diameter of less than approximately 14 mm at the hosel top end.

8. The golf club head of claim 7, wherein:
the hosel bore comprises a hosel coupler proximate the hosel top end;
the shaft sleeve comprises a sleeve outer wall bounding the sleeve bore and comprising a sleeve coupler; and
the sleeve coupler of the sleeve outer wall is configured to engage the hosel coupler of the hosel bore, proximate the hosel top end and within the hosel diameter, to restrict a rotation of the shaft sleeve relative to the hosel.

9. The golf club head of claim 1, wherein:
when the golf club head is at an address position, with the shaft sleeve secured in the hosel:
the assembled club head mass defines an assembled club head center of gravity located at a vertical distance of less than approximately 15.0 mm from the shaft sleeve center of gravity.

10. A method for manufacturing a golf club head, the method comprising:
manufacturing a club head body comprising a hosel;
providing a shaft sleeve configured to couple with the hosel; and
providing a securing fastener configured to secure the shaft sleeve to the club head body;
wherein:
the shaft sleeve is configured to repositionably couple a golf club shaft with the club head body;
the securing fastener is configured to couple a bottom end of the shaft sleeve;
the golf club head comprises:
an assembled club head mass of the club head body, the shaft sleeve, and the securing fastener, when the club head body is coupled to the shaft sleeve and the securing fastener; and
a disassembled club head mass of the club head body when the club head body is decoupled from the shaft sleeve and the securing fastener;
the hosel comprises:
a hosel bore configured to receive the shaft sleeve;
the shaft sleeve comprises:
a sleeve mass; and
a sleeve bore configured to receive an end of the golf club shaft;
the securing fastener comprises a securing fastener mass;
the sleeve mass is less than approximately 3% of the assembled club head mass;
the club head comprises a driver-type club head;
the shaft sleeve comprises a shaft sleeve center of gravity; and
when the golf club head is at an address position, with the shaft sleeve secured in the hosel:
the shaft sleeve center of gravity is located at a sleeve CG vertical distance of less than approximately 43.7 mm relative to a sole bottom end of a sole of the golf club head.

11. The method of claim 10, wherein:
a sleeve combined mass comprises the sleeve mass and the securing fastener mass; and
the sleeve combined mass is less than approximately 4% of the disassembled club head mass.

12. The method of claim 10, wherein:
the disassembled club head mass is less than or equal to approximately 205 grams;
the sleeve mass is less than approximately 6 grams;
a sleeve combined mass, comprising the sleeve mass and the securing fastener mass, is less than approximately 7.5 grams; and
the assembled club head mass is less than or equal to approximately 213 grams.

13. The method of claim 10, further comprising:
coupling the shaft sleeve with the hosel; and
coupling the securing fastener to a bottom end of the hosel and the bottom end of the shaft sleeve.

* * * * *